United States Patent [19]

Macdonald et al.

[11] Patent Number: 4,807,447

[45] Date of Patent: Feb. 28, 1989

[54] HUMAN ENVIRONMENTAL CONDITIONER

[76] Inventors: James R. Macdonald, 627 Greenwood Ave., Akron, Ohio 44320; George Spector, 233 Broadway, Rm 3815, New York, N.Y. 10007

[21] Appl. No.: 113,495

[22] Filed: Oct. 28, 1987

[51] Int. Cl.[4] ..... F25D 23/12

[52] U.S. Cl. ..... 62/259.3; 126/204; 165/46

[58] Field of Search ..... 62/259.3; 126/204; 165/46; 128/362, 379, 399, 400, 402

[56] References Cited

U.S. PATENT DOCUMENTS 2,429,234 10/1947 Miller ..... 62/259.3

3,411,156 11/1968 Feher ..... 62/259.3

*Primary Examiner*—Henry A. Bennet

[57] ABSTRACT

A human environmental conditioner is provided and consists of a plurality of closed recirculating conduits extending from a turbo pump compressor rotary generator worn on waist of an undergarment that is worn over body of a person. A heat exchanger is formed into the undergarment by interweaving the conduits carry refrigerant fluid to various areas of the body to keep the person cool in summer and warm in winter.

1 Claim, 2 Drawing Sheets

HUMAN ENVIRONMENTAL CONDITIONER

BACKGROUND OF THE INVENTION

The instant invention relates generally to body protective suits and more specifically it relates to a human environmental conditioner.

Numerous body protective suits have been provided in prior art that are adapted to keep the person's body either warm or cool depending upon ambient environment conditions. For example, U.S. Pat. Nos. 3,737,620, 3,869,871 and 4,172,454 all are illustrative of such prior art. While these units may be suitable for the particular purpose to which they address, they would not be as suitable for the purposes of the present invention as heretofore described.

SUMMARY OF THE INVENTION

A primary object of the present invention is to provide a human environmental conditioner that will overcome the shortcomings of the prior art devices.

Another object is to provide a human environmental conditioner that will allow the human body to be nearly at a constant, stable temperature all the time.

An additional object is to provide a human environmental conditioner whereby the same style of clothing can be worn the year round thus eliminating heavy bulky clothing.

A further object is to provide a human environmental conditioner that is simple and easy to use.

A still further object is to provide a human environmental conditioner that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
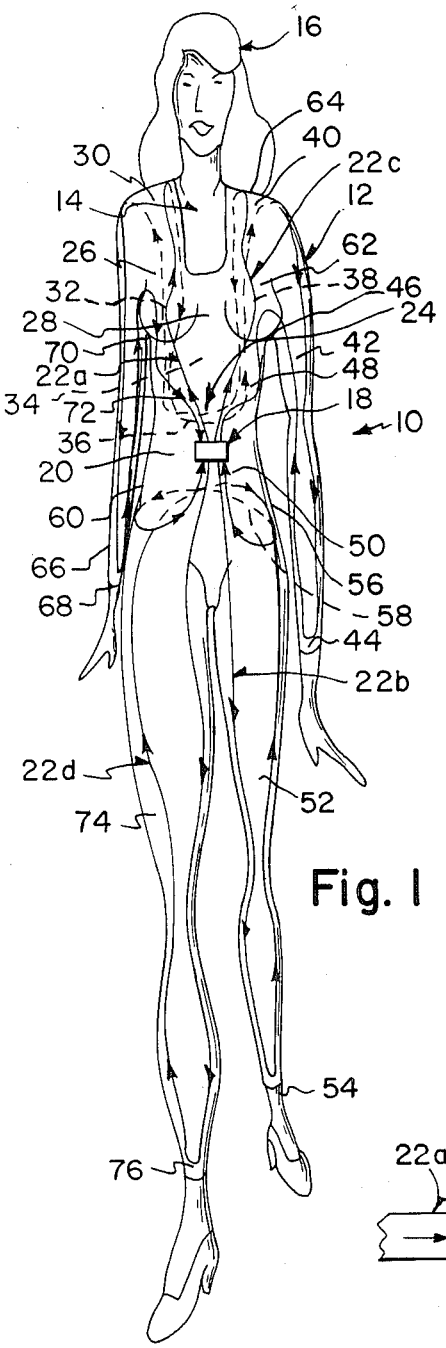
FIG. 1 is a front view of the invention being worn by a woman.
Figure 2:
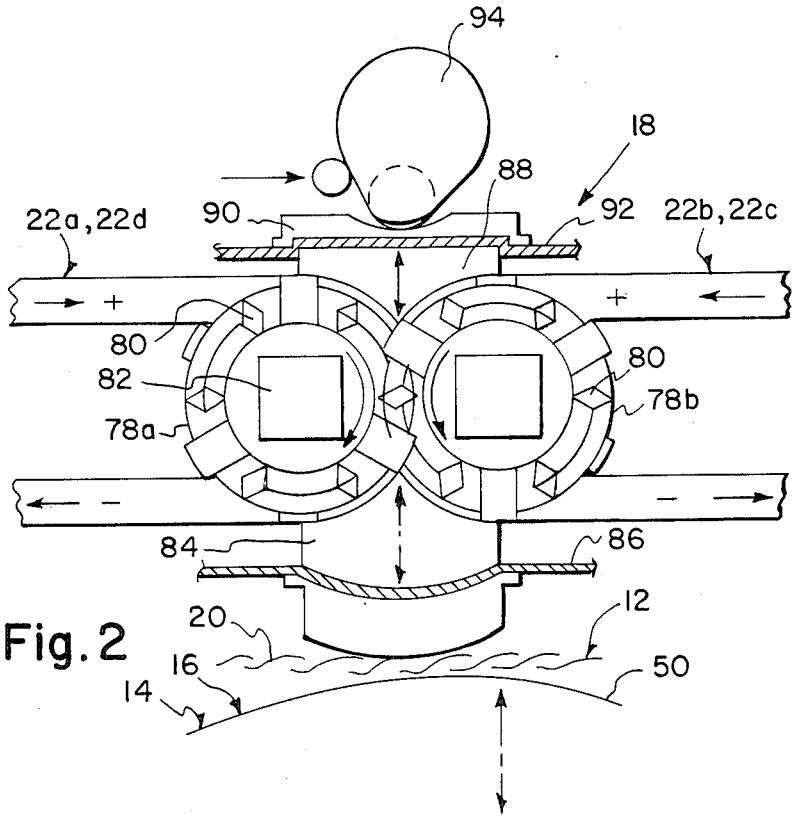
FIG. 2 is a cross sectional end view of the turbo pump compressor rotary generator.
Figure 3:
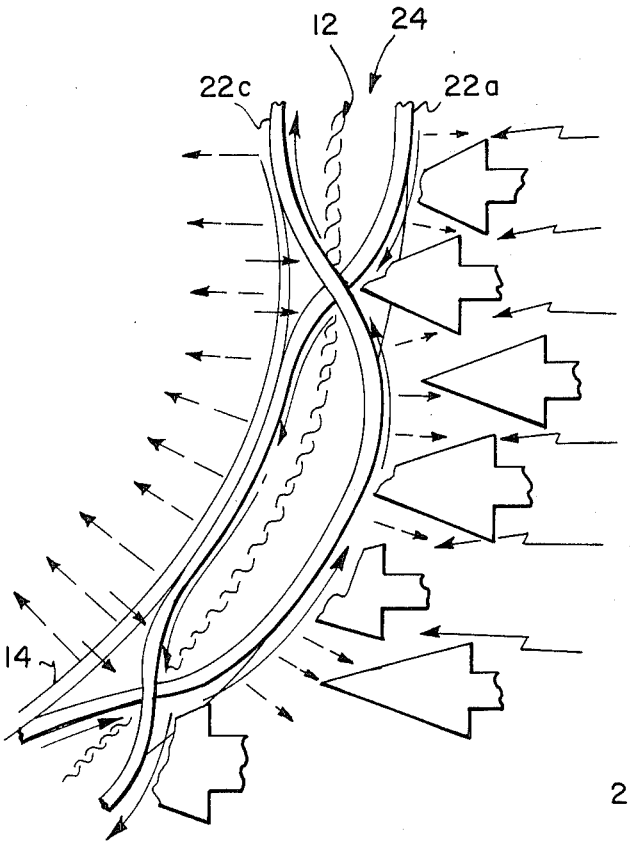
FIG. 3 is a cross sectional view of the heat exchanger during a winter condition.
Figure 4:
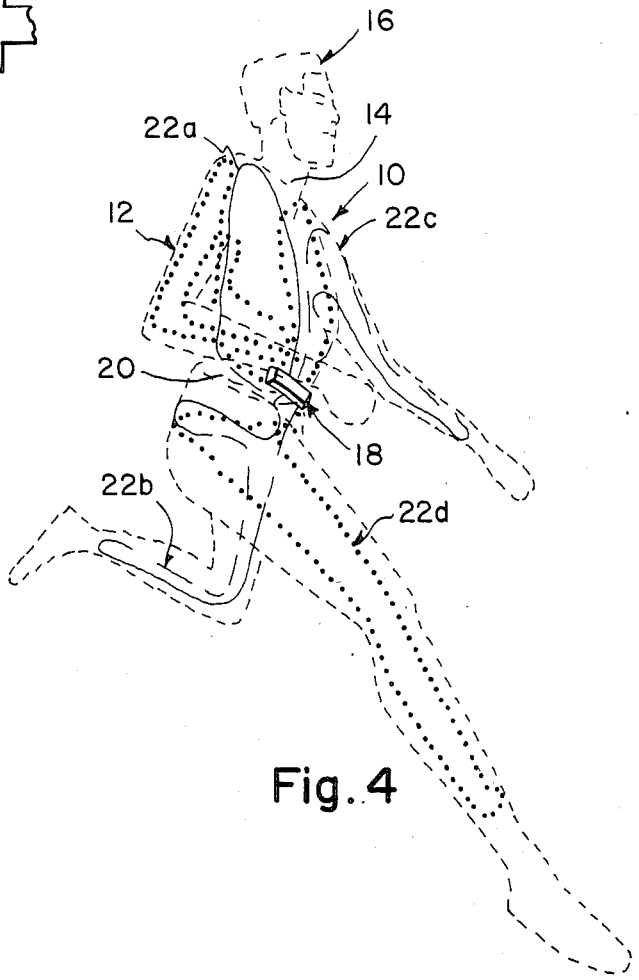
FIG. 4 is a side view of a man running track shown in phantom wearing the invention.

Turning now descriptively to the drawings, in which similar reference characters denote similar elements throughout the several views, FIGS. 1 and 4 illustrates a human environmental conditioner 10 which consists of an undergarment 12 worn over body 14 of a person 16. A turbo pump compressor rotary generator 18 as best seen in FIG. 2, is worn on waist 20 of the under garment 12 so that the generator 18 can circulate refrigerant fluid therefrom. A plurality of closed, recirculating conduits **22*a* 22*b*, 22*c* and 22*d* extending from the generator 18 are for carrying the refrigerant fluid through the undergarment 12 to various areas of the body 14 of the person 16. A heat exchanger 24, shown in FIG. 3 in greater detail is formed into the undergarment 12 by interweaving the conduits 22*a* and 22*c*, to keep the body 14 of the person 16** cool in summer and warm in winter at a constant body temperature.

As best shown in FIG. 1, during the summer months the condensed refrigerant fluid is pumped from the generator 18 up through conduit **22*a* past right side 26 of chest 28 to right shoulder 30, (the refrigerant at a cool temperature), down right side 32 of back 34, (the refrigerant warming up from the heat exchanger 24 from outside weather and body heat), across the pit 36 of the back 34 up left side 38 of the back 34, (the refrigerant still warmer almost a vapor), to left shoulder 40, down left arm 42, to left wrist 44, up inside of the left arm 42, under left arm pit 46 and down along left ribs 48, (the refrigerant completely vaporized), to the generator 18**, where it is compressed back into a fluid.

Generator 18 then pumps the condensed refrigerant fluid through conduit **22*b* down abdomen 50, down left leg 52, (the refrigerant at a cool temperature), to left ankle 54, up outside of the left leg 52, (the refrigerant fluid warming up), to left hip 56, across buttocks 58, to right hip 60, (the refrigerant almost a vapor), around the right hip 60, (the refrigerant completely vaporized), up the abdomen 50 to the generator 18**.

The refrigerant fluid is then pumped through conduit **22*c* up left side 62 of the chest 28, to left shoulder 64 (the refrigerant is at a cool temperature), down the left side 38 of the back 34, (the refrigerant warming up from the heat exchanger 24 from outside weather and body heat), across the pit 36 of the back 34 up the right side 32 of the back 34, (the refrigerant still warming almost to a vapor), to the right shoulder 30, down right arm 66 to right wrist 68, up inside of the right arm 66, under right arm pit 70 down along right ribs 72, (the refrigerant completely vaporized), to the generator 18** where it is compressed back into a fluid.

The generator 18 then pumps the condensed refrigerant fluid through conduit **22*d*, down the abdomen 50, down right leg 74, right ankle 76, up the right leg 74, to the right hip 60, across the buttocks 58 to the left hip 56 (the refrigerant almost a vapor), around the left hip 56, up the abdomen 50 to the generator 18**.

The turbo pump compressor rotary generator, as shown in FIG. 2, consists of a pair of turbo rotors **78*a* and 78*b* that have staggered vented flanges 80. The rotor 78*a* is in cooperation with the conduits 22*a* and 22*b* and 22*c*. Rotor 78*a* rotates clockwise and is driven by a motor (not shown) via shaft 82 causing the other rotor 78*b* to rotate counterclockwise. A first modular valve shoe 84 has a diaphram 86 and is positioned on one side of the rotors 78*a* and 78*b* to be moved up and down by the breathing of the person 16 to compress the refrigerant passing through the rotors. A second modular valve shoe 88 that has a followe 30 and diaphram 92 and is positioned on opposite side of the rotors 78*a* and 78*b*. A cam 94 is provided and is driven by the motor. The cam 94 engages the follower 90 on the second modular valve shoe 88 to be moved up and down to compress the refrigerant passing through the rotors 78*a* and 78*b***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A human environmental conditioner which comprises:

(a) an undergarment worn over body of a person;

(b) a turbo pump compressor rotary generator worn on waist of said undergarment so that said generator can circulate refrigerent fluid therefrom;

(c) a plurality of closed recirculating conduits extending from said generator for carrying the refrigerant fluid through said undergarment to various areas of the body of the person, and (d) a heat exchanger formed into said undergarment by interweaving said conduits to keep the body of a person cool in summer and warm in winter at a constant body temperature, wherein said turbo pump compressor rotary generator comprises:

(e) a pair of turbo rotors having staggered vented flanges, said rotors in cooperation with said conduits, one of said rotors rotates clockwise and is driven by a motor, causing other of said rotors to rotate counterclockwise;

(f) a first modular valve shoe piston having a diaphram and positioned on one side of said rotors to be moved up and down by the breathing of the person to compress the refrigerant passing through said rotors;

(g) a second modular valve shoe piston having a follower and diaphram and positioned on opposite side of said rotors; and (h) a cam driven by the motor, said cam engaging the follower on said second modular valve shoe to be moved up and down to compress the refrigerant passing through said rotors.

* * * * *